United States Patent [19]

Ghandour

[11] 4,418,494

[45] Dec. 6, 1983

[54] RETURNING BALL TOY

[76] Inventor: Edmond Ghandour, 2636 Stuart St., Berkeley, Calif. 94705

[21] Appl. No.: 225,133

[22] Filed: Jan. 14, 1981

Related U.S. Application Data

[63] Continuation of Ser. No. 923,155, Jul. 10, 1978, abandoned.

[51] Int. Cl.[3] ..... A63H 27/12

[52] U.S. Cl. ..... 46/61

[58] Field of Search ..... 46/61, 59, 60, 50

[56] References Cited

U.S. PATENT DOCUMENTS

| | | | |
|---|---|---|---|
| 1,963,001 | 6/1934 | Savage | 46/61 X |
| 3,287,846 | 11/1966 | Frangos | 46/61 |
| 3,362,101 | 1/1968 | Grow | 46/61 X |
| 3,724,121 | 4/1973 | Atkins et al. | 46/61 |

FOREIGN PATENT DOCUMENTS

| | | | |
|---|---|---|---|
| 914829 | 7/1954 | Fed. Rep. of Germany | 46/61 |
| 362694 | 12/1931 | United Kingdom . | |

*Primary Examiner*—Mickey Yu

*Attorney, Agent, or Firm*—Majestic, Gallagher, Parsons & Siebert

[57] ABSTRACT

The toy is a ball or similar projectile which may be thrown and then retrieved by a hand-held line. The line winds on a reel, as in a yo-yo. The reel is connected to the ball by a torsion spring which winds up as the ball is thrown and then unwinds, reeling in the line and returning the ball to the hand. The toy requires less skill than a yo-yo.

6 Claims, 2 Drawing Figures

RETURNING BALL TOY

This is a division of Ser. No. 923,155, filed July 10, 1978 now abandoned.

FIELD OF THE INVENTION

The invention pertains to a manual toy the manipulation of which gives pleasure and requires a certain amount of skill.

PRIOR ART

The yo-yo has been a popular toy in many cultures for a very long time. It is of simple construction but requires considerable skill to operate. There is a natural fascination in throwing an object and having it come back. The boomerang and the ball on a rubber cord are other old toys.

SUMMARY OF THE INVENTION

The object of the invention is to provide a toy having the retrieving ability of the yo-yo but which requires little skill to operate.

This object is achieved by having a hand-held line or cord connected to a projectile or ball which contains a reel for winding the line. When the projectile is thrown, unwinding the line from the reel, a torsion spring connecting the reel to the frame of the projectile is wound up. Eventually the torsion in the spring or the reaching of the end of the line, stops the ball. The torsion in the spring then reverses the reel and rewinds the line to return the projectile to the hand.

DESCRIPTION OF THE PREFERRED EMBODIMENTS

The use of the invention is to retrieve a hand-thrown projectile such as a ball by the stored energy in a spring. Unlike the yo-yo where energy is stored as angular momentum, the spring storage has no critical axis of rotation and no appreciable gyroscopic effect, so the projectile can be thrown in almost any fashion and direction, making the toy relatively easy to use and providing extended entertainment.

It will be apparent that the invention can encompass a wide variety of physical forms and mechanisms. The embodiments described are purely illustrative.

Figure 1:
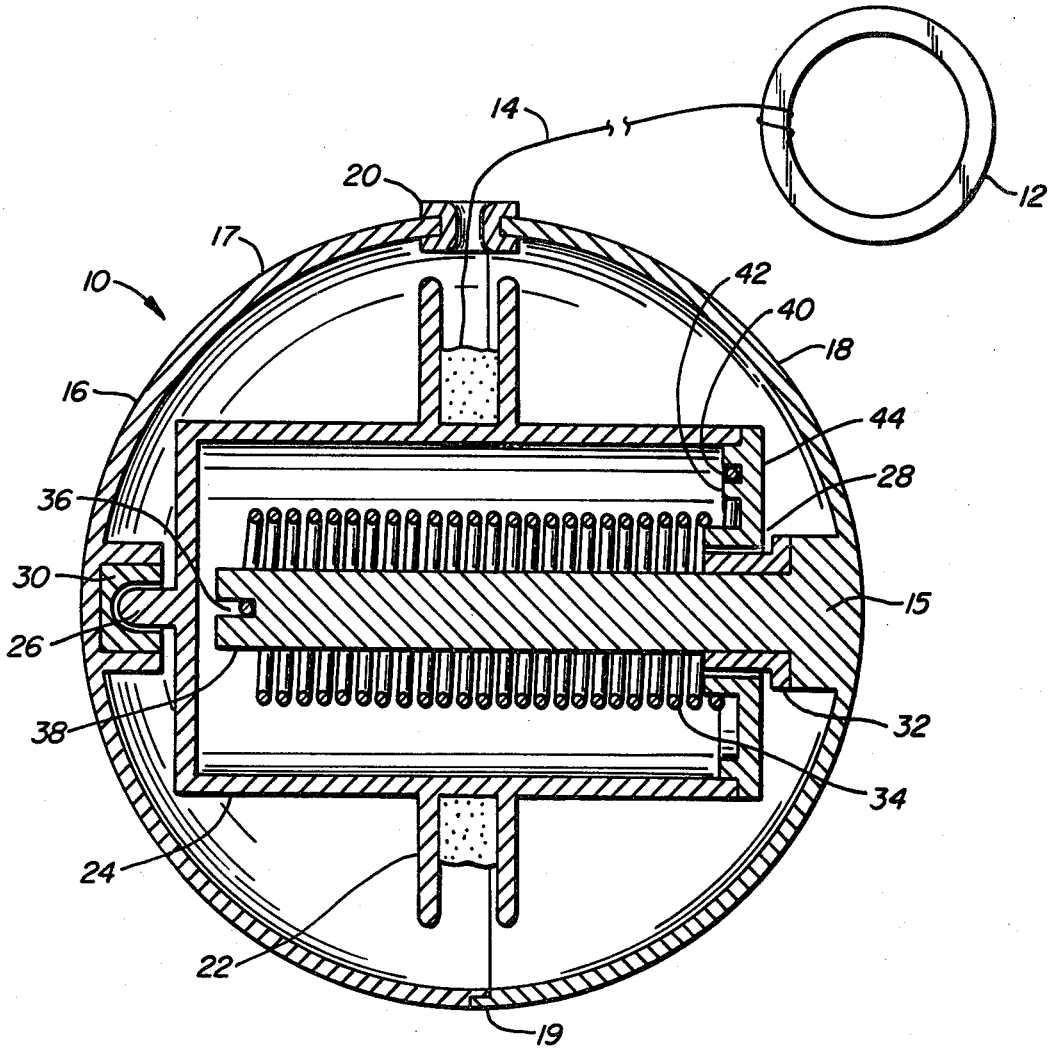
FIG. 1 is a cross-sectional view of the preferred embodiment of the invention.

FIG. 1 shows a preferred embodiment in which the projectile has a spherical shape. The projectile 10 is connected to a hand-held retainer 12 by a flexible line 14. Retainer 12 is shown as a ring to be slipped over a finger. However, any other retaining means, even a loop at the end of line 14, may be substituted. Line 14 is for example a nylon monofilament such as is widely used for fishing line. a twisted or woven cord may be used, but the monofilament is cheap and has low sliding friction.

The frame 15 of projectile 10, which may be of molded plastic for example, comprises a spherical outer container 16 formed of two mating hemispheres 17 and 18, and interior elements to be described later for positioning and actuating the retrieval mechanism. Hemispheres 17, 18 are joined together at lips 19, which may or may not overlap or interlock, as the final step in assembling projectile 10 as for example by gluing. A grommet 20 is captured in a hole at the joing of hemispheres 17 and 18. Grommet 20 forms the entrance hole in container 16 for connecting line 14. It is preferably of metal to provide low sliding friction for line 14 and low wear of the grommet itself. However, a wear-resistant plastic may be used.

Inside outer container 16, line 14 is attached and wound on a reel 22 which has a hollow hub 24. Hub 24 is rotatably supported by a bearing pin 26 at one end and a bearing sleeve 28 at the other end. Pin 26 and sleeve 28 slide on fixed bearing elements 30 and 32, which are rigidly mounted to frame 15 of projectile 10. Elements 30 and 32 may be of low-friction material such as flourocarbon polymer, or may be metallic or may be just a part of the frame 15 moldings.

Reel hub 24 is connected to frame 15 by a torsion spring 34, shown here as a metallic wire coil spring. Alternatively, any other kind of torsion spring may be used, such as a clock-type coiled metallic strip or even a rubber band wound on a reel which produces similar retrieving action.

One end 36 of spring 34 is fastened, as by inserting in a slot, to the end of a fixed post 38 which is part of projectile frame 15 extending inside hollow hub 24 and spring 34 for most of their lengths. The other end 40 of spring 34 is fastened to hub 24 by wrapping around a stud 42 on the hub end enclosure 44 which is a rigidly attached part of hub 24. Alternatively, the spring may be threaded onto sleeve 28 of hub 24 or glued to it.

In assembling projectile 10, the spring 34 may be twisted so that when line 14 is completely wrapped on reel 22 there is still a little torsion tending to pull line 14 into projectile 10. Alternatively, the spring 34 may be left in its untorqued state with the line 14 wrapped around reel 22. In operating the toy, projectile 10 is thrown out, line holder 12 remaining attached to the hand. As the ball moves away, line 14 pays out causing relative rotation of reel 22 with respect to frame 15. This increases the torsion in spring 34 which eventually becomes so great that further paying-out of line 14 is stopped. The paying-out of line 14 may also be stopped by merely reaching the end of line 14. Then the torsion in spring 34 reverses the motion of reel 22, hauling in line 14 and returning projectile 10 to the hand.

Figure 2:
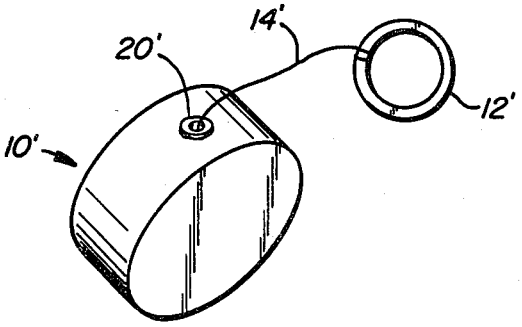
FIG. 2 is a perspective view of an alternative embodiment.

FIG. 2 ilustrates an alternative embodiment in which the outer container 16' of projectile 10' is cylindrical, resembling somewhat the traditional yo-yo. As stated above, the particular configuration may vary widely within the scope of the invention. Polyhedral shapes may be used. The frame of the projectile need not have a completely closed outer container, but may be only a framework. The scope of the invention is intended to be limited only by the following claims and their legal equivalents.

I claim:

1. A toy, comprising:

(a) a hollow rotatable hub member;

(b) a reel mounted on the hub member;

(c) a rigid housing containing said hub member and reel;

(d) a fixed axle rigidly mounted in the housing and supporting the hub member for relative rotation with respect to the housing, said axle having a free end located within the hub member;

(e) a torsion spring located within the housing and having two ends, one end being operatively attached to the housing and the other end attached to the hub member so that relative rotation between the hub member and the housing is resisted by tension in the spring; and (f) a flexible cord having a first end attached to the reel and a second free end passed through the housing, said cord being adapted for being coiled about the reel so that when the cord is moved, the reel and hub member rotate about the axle relative to the housing, resisted by the tension in the spring.

2. A toy as in claim 1 wherein the end of the spring that is operatively connected to the housing is connected to the free end of the axle.

3. A toy as in claim 1 wherein the hub member includes a bearing pin attached thereto, said bearing pin being coaxial with the axle and supported with respect to the housing by a bearing element attached to the housing.

4. A toy as in claim 1 wherein the housing includes a spherically shaped outer wall fabricated from two mating hemispherical elements.

5. A toy as in claim 1 wherein the housing includes an outer wall having the shape of a right circular cylinder with two planer end walls.

6. A toy as in claim 1 wherein said cord is an organic polymer monofilament line.

* * * * *